US005764041A

United States Patent [19]

Pulvirenti et al.

[11] Patent Number: 5,764,041

[45] Date of Patent: Jun. 9, 1998

[54] SHORT CIRCUIT LIMITATION CURRENT FOR POWER TRANSISTORS

[75] Inventors: Francesco Pulvirenti, Acireale; Gregorio Bontempo, Barcellona P.G., both of Italy

[73] Assignee: Consorzio per la Ricerca sulla Microelettronica nel Mezzogiornio, Catania, Italy

[21] Appl. No.: 802,334

[22] Filed: Feb. 11, 1997

[51] Int. Cl.[6] ..... G05F 1/56

[52] U.S. Cl. ..... 323/282; 323/273

[58] Field of Search ..... 323/265, 269, 323/273, 280, 281, 282; 327/387, 389, 427, 538, 541, 543

[56] References Cited

U.S. PATENT DOCUMENTS

| | | | |
|---|---|---|---|
| 5,084,668 | 1/1992 | Kotowski et al. | 323/315 |
| 5,184,272 | 2/1993 | Suda et al. | 361/87 |
| 5,285,148 | 2/1994 | Uhlenhoff et al. | 323/272 |
| 5,361,008 | 11/1994 | Saijo | 327/427 |
| 5,365,161 | 11/1994 | Inoue | 323/282 |
| 5,373,225 | 12/1994 | Poletto et al. | 323/282 |
| 5,408,172 | 4/1995 | Tanimoto et al. | 323/273 |
| 5,557,193 | 9/1996 | Kajimoto | 323/282 |

FOREIGN PATENT DOCUMENTS

| | | |
|---|---|---|
| 0 483 744 | 5/1992 | European Pat. Off. . |
| 38 21 065 | 1/1989 | Germany . |

*Primary Examiner*—Matthew V. Nguyen
*Attorney, Agent, or Firm*—Jenkens & Gilchrist; Michele A. Mobley

[57] ABSTRACT

The purpose of the present invention is to protect the final transistor of a power actuator from short circuits and overloads with a completely integrated circuitry solution which would not influence the output impedance of the actuator and would permit having a limitation current constant and independent of the value of the output terminal of the actuator. A power actuator in accordance with the present invention incorporates a circuit for limitation of the maximum current delivered by the power transistor wherein the circuit comprises: (a) a network for detection of the current delivered by the power transistor which generates a first electrical signal proportional to said current, (b) a reference network generating a reference electrical signal, and (c) an operational amplifier which compares the first electrical signal with the reference electrical signal and which tends to inhibit the power transistor if the current delivered exceeds a certain threshold value and whose output terminal is coupled to the reference network in such a manner that the reference electrical signal depends on the voltage present at the amplifier output.

9 Claims, 3 Drawing Sheets

SHORT CIRCUIT LIMITATION CURRENT FOR POWER TRANSISTORS

FIELD OF THE INVENTION

The present invention relates to a circuit for protecting the output stage of an intelligent power actuator from overloads and short circuits. The need to protect these devices, which can be switches, amplifiers and voltage or current regulators, is clear when the power in play is high because an overload or an accidental short circuit could irreversibly damage both the load and the device itself.

PRIOR ART

The output stage of the subject devices is provided by a power transistor and the technique used to limit current is to drive the transistor involved with a negative feedback network which tends to inhibit the transistor itself when the current running in it exceeds a certain predefined threshold. The simplest way to detect the current is to measure the voltage drop on a resistor—termed 'sense' resistor—placed in series with the power transistor.

FIG. 1 shows a known circuitry solution for a current limitation circuit in a final stage of a power actuator. A power transistor PW has a principal conduction path D-S placed in series with a sense resistor RS between a positive pole Vcc of a supply voltage generator and an output terminal OUT of the final stage. A voltage comparator provided here by means of an operational amplifier 3 compares the voltage drop on the sense resistor RS, proportional to the current running in the principal conduction path D-S of the power transistor PW with a reference voltage VR. The operational amplifier 3 together with the sense resistor RS and the reference voltage VR constitutes a negative feedback network which tends to inhibit the power transistor PW when the current Iout on the output branch exceeds a certain predefined threshold termed short-circuit current Icc.

The value of the short-circuit current Icc can be readily obtained by equalizing the input voltages of the operational amplifier 3 because in case of short circuit the operational amplifier 3 is balanced:

$$I_{CC}=\frac{V_R}{R_S}$$

The value of this current remains constant in the entire interval of the output terminal and even in case of overloads the maximum current delivered by PW is Icc.

This circuitry solution presents the serious problem of increasing the resistance of the output stage because of the presence of the sense resistor RS.

The increasing requirement in recent years for devices with ever higher output current and ever lower voltage drop on the output branch has encouraged the use of MOS transistors in place of the bipolar transistors for the output stage because they permit reduction to the minimum of the voltage drop, allowing minimization of power dissipation.

It is thus evident that measurement of the current directly on the output branch with a sense resistor has the disadvantage of increasing the voltage drop and worsening the thermal performance as well as the electrical performance of the device.

To obviate this shortcoming another prior art much used in these cases is that of measuring, again through a sense resistor, a current proportional to the output current obtained by dividing the power transistor as shown in the diagram of FIG. 2.

In the circuitry solution of FIG. 2 the output current Iout is divided and only a part thereof is measured through a sense resistor RS connected in series with a sense transistor PS with the clear advantage that the output resistance is not altered.

The transistor PS (termed 'power sense') must be well coupled with the power transistor PW and is sized with an area n times smaller than the total area occupied by both the transistors. In this manner, when both the transistors PW and PS work in the saturation region the current running in the PW has a value of Is=Iout/n.

In the case of a short circuit the current Icc can be calculated by equalizing the input voltages of the operational amplifier 3 which has the following value.

$$I_{CC}=n\cdot\left[\frac{R_R}{R_S}\right]\cdot I_R$$

The reference voltage VR is obtained in this circuit by passing the current of the generator IR in the reference resistor RR. Of course this solution does not have the shortcoming of increasing the resistance of the output stage but in this case the measurement proves to be affected by errors when the transistors PS and PW work in a resistive zone. This phenomenon is shown in the chart of FIG. 3 in which is made clear the behavior of the short circuit Icc as a function of the output voltage Vout.

This phenomenon can be explained by the fact that when the voltage Vout on the output terminal is near the power supply voltage the two transistors PW and PS pass from the saturation region, where they behave as current generators, to the resistive zone and the voltage drop on RS changes the point of operation of PS to modify the value of the mirrored current Is.

Under these operating conditions the mirrored current Is becomes:

$$I_S=\left[\frac{R_S}{R_S+nR_D}\right]\cdot I_{out}$$

where RD is the saturation resistance of the power transistor PW and $nR_D$ is the saturation resistance of the sense transistor PS.

It follows that the value of the limitation current does not remain constant in the entire interval of the output voltage but displays a peak near the resistive zone which in certain cases can be more than double the value of the short circuit current.

The peak value Ip which the current Iout can reach is easy to calculate, allowing for the assumed value of Is when both transistors work in the resistive zone, by equalizing the input voltages of the operational amplifier 3 and is given by the following equation.

$$I_p=\left[1+\frac{R_S}{nR_D}\right]\cdot I_{CC}$$

In the case of an overload the limitation current can be moved away from the short circuit current by an amount dependent upon the sense resistor RS and the saturation resistance of the output transistor reaching a maximum value Ip which, from the practical applications, was seen to be double the current Icc.

The technical problem underlying the present invention is to protect the final transistor of a power actuator from short circuits and overloads with a completely integrated circuitry solution which would not influence the output impedance of the actuator and would permit having a constant limitation current independent of the output voltage value of the actuator.

The technical problem is solved by a limitation circuit for the maximum current delivered by a power transistor of the type indicated described in claims 1 to 4.

The technical problem is also solved by a power actuator protected at output from overloads and short circuits and of the type indicated and described in claims 5 to 9.

The characteristics of the present invention are clarified in the detailed description given below of the invention's practical embodiments illustrated by way of non-limiting example in the annexed drawings.

DETAILED DESCRIPTION OF A PREFERRED EMBODIMENT OF THE INVENTION

Figure 4:
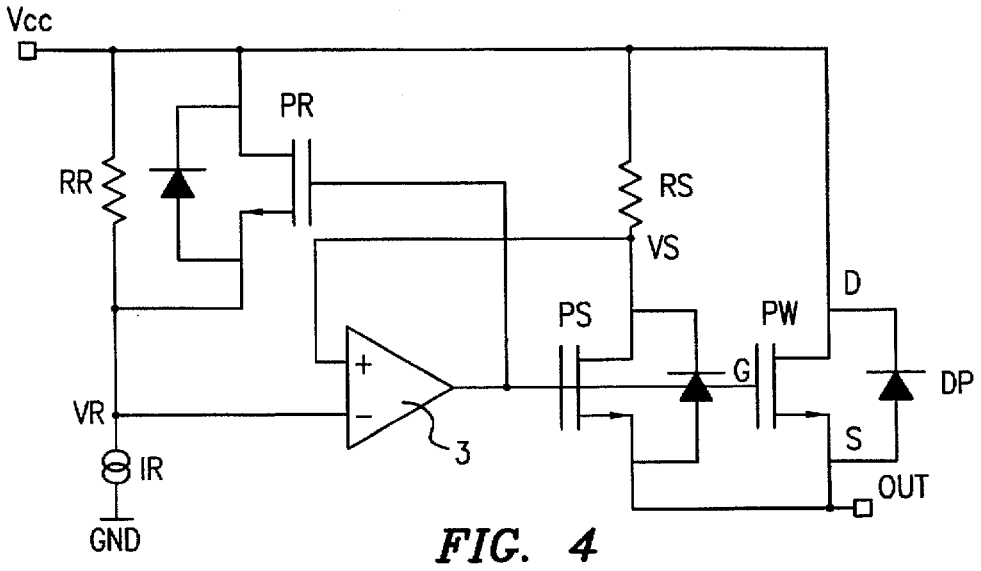
FIG. 4 shows a current limitation circuit diagram provided in accordance with the present invention.

FIG. 4 shows an output current limitation circuit of a power actuator provided in accordance with the present invention.

This circuit is used in a final stage of a 'high side' actuator in which a power transistor PW is used for supplying a load with a positive voltage.

The power transistor PW has a control terminal G termed 'gate', a first principal conduction terminal D termed 'drain', and a second principal conduction terminal S termed 'source'.

The first D and second S principal conduction terminals identify a principal conduction path D-S which is connected between a positive pole Vcc of a power supply generator and the output node OUT of the actuator. In parallel with the path D-S is indicated in the figure a diode DP. This diode is normally present in the integrated MOS power transistors because it is intrinsic to the structure itself.

A network for detection of the current delivered by the power transistor PW comprises a sense transistor PS and a sense resistor RS.

The sense transistor PS has a principal conduction path connected in series with the resistor RS in parallel with the principal conduction path D-S of the power transistor PW between the positive pole Vcc and the output node OUT of the actuator.

The gate terminals of the transistors PW and PS both are connected to the output of an operational amplifier 3 used as a voltage comparator. A non-inverting input of the amplifier 3 is connected to the common node between the sense transistor PS and the sense resistor RS while an inverting input is connected to the common node between a reference current generator IR and a resistor RR. The resistor RR and the generator IR which form a reference network are connected in series between the positive pole Vcc of the power supply generator and a reference GND of the circuit so as to generate a reference voltage VR. In parallel with the resistor RR is placed the conduction path of a transistor PR having a control terminal—or gate—also connected to the output terminal of the operational amplifier 3.

There is now described the operation of the circuit of FIG. 4.

Figure 1:
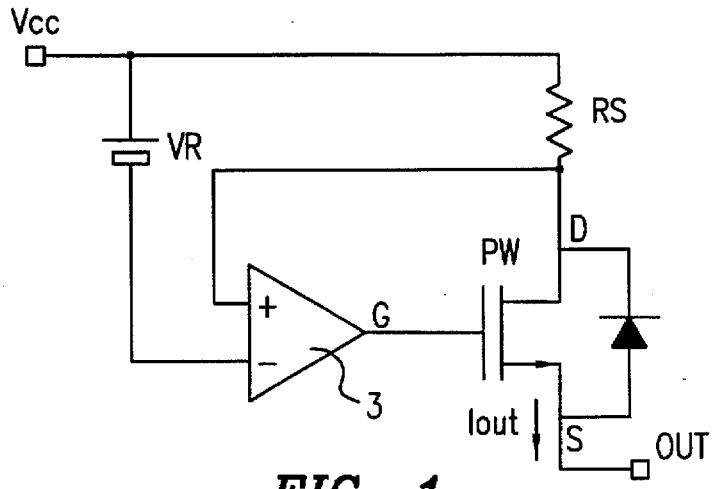
FIG. 1 shows a first circuitry solution of a current limitation circuit of known type.
Figure 2:
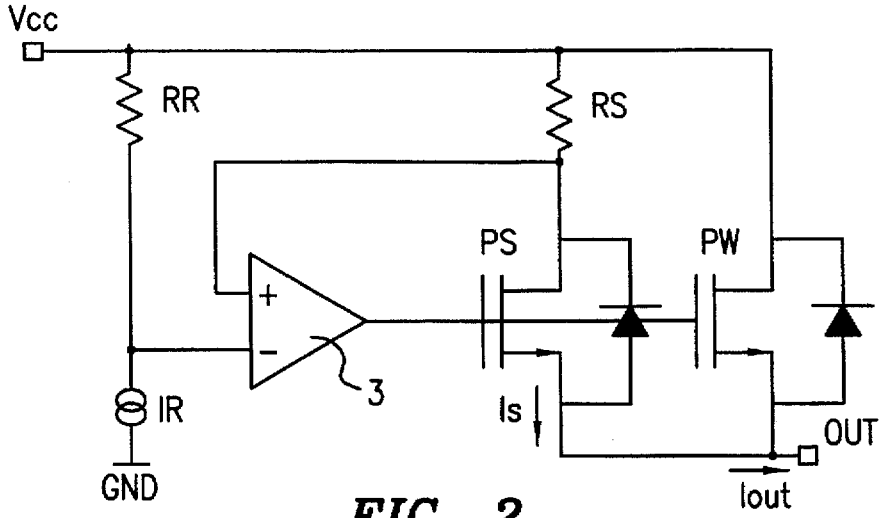
FIG. 2 shows a second circuitry solution of a current limitation circuit of known type.
Figure 3:
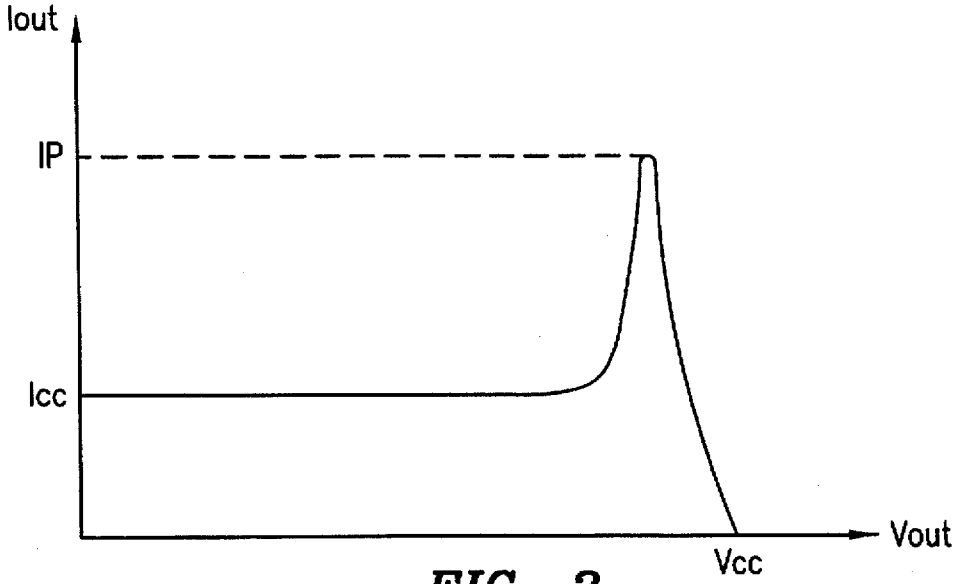
FIG. 3 shows in a voltage-current diagram the behavior of the circuit of FIG. 2.

The basic idea of the innovative solution for eliminating the limitation current peak, such as that shown in FIG. 2, is that of compensating the effect introduced by the sense resistor RS on the sense transistor PS when the latter works in the resistive zone, acting on the reference voltage VR at the inverting input of the operational amplifier 3.

To facilitate the explanation of this concept we shall write the value of the voltage VS at the non-inverting input of the operational amplifier 3 when the two transistors RS and PS work in the resistive zone:

$$V_S = R_S \cdot I_S = \frac{R_S \cdot R_D}{R_S + nR_D} \cdot I_{out} = \frac{1}{n} \cdot [R_S \| nR_D] \cdot I_{out}$$

Hence the voltage VS is a function of $R_S \| nR_D$, that is of the parallel of the sense resistor RS with the saturation resistance of the sense transistor PS which is equal to n times the saturation resistance RD of the power transistor PW.

To compensate for the effect of the variation of the saturation resistance of the sense transistor PS, the circuit in accordance with the present invention calls for reproduction of the same resistance on the other input of the operational amplifier 3 by placing in parallel with the reference resistor RR a MOS transistor PR appropriately sized and coupled with the transistors PS and PW.

To achieve optimal coupling the transistor PR can be designed in the same pocket as the power transistor PW since both have a common drain terminal and must have an area m times smaller than the transistor PS. In addition, the ratio of the resistor RR to the resistor RS must be equal to m, as follows.

$$\frac{R_R}{R_S} = m$$

The saturation resistance of the transistor PR is thus equal to nmRD, that is m times the saturation resistance of the transistor PS which in turn was n times the saturation of the transistor PW.

If we calculate the voltage VR on the inverting input of the operational amplifier 3 we find the following value:

$$V_R = (R_R \| nmR_D) \cdot I_R = (mR_S \| nmR_D) \cdot I_R = m \cdot (R_S \| nR_D) \cdot I_R$$

We can calculate the current peak Ip in the case of an overload by equalizing the input voltages VS and VR of the operational amplifier 3 as follows.

$$V_S = 1/n \cdot (R_S \| nR_D) \cdot I_p \cdot m \cdot (R_S \| nR_D) \cdot I_R = V_R$$

that is $$I_p = nmI_R = n\frac{R_R}{R_S} \cdot I_R = I_{CC}$$

Figure 6:
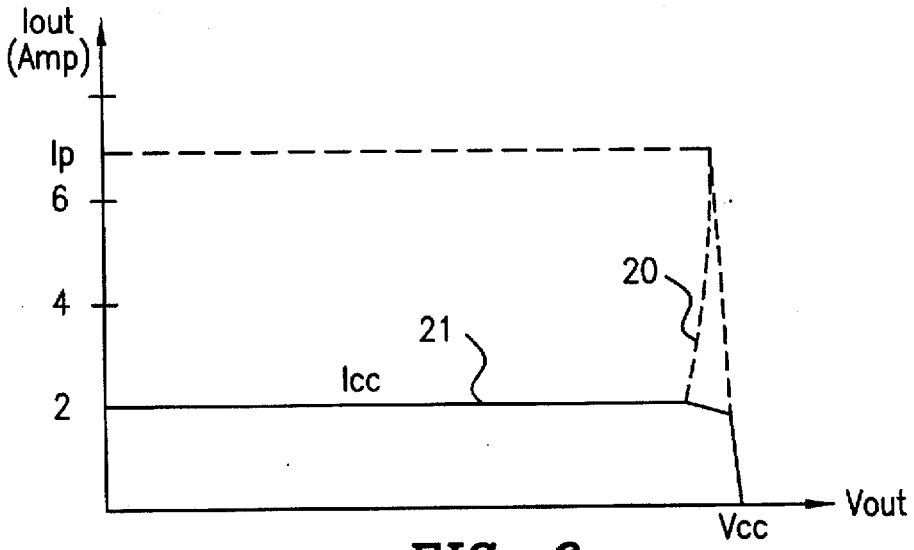
FIG. 6 shows in a voltage-current diagram the behavior of the circuit of FIG. 4 compared with the behavior of a circuit of known type.

In FIG. 6 is shown the behavior of the short circuit current Icc as a function of the output voltage Vout for the circuit of FIG. 4, curve 21, and for the circuit provided in accordance with the prior art shown in FIG. 2, curve 20.

It is seen clearly that the current peak of value Ip present in the curve 20 for the prior art circuit is completely eliminated and the short circuit current Icc remains virtually constant over the entire interval.

Figure 5:
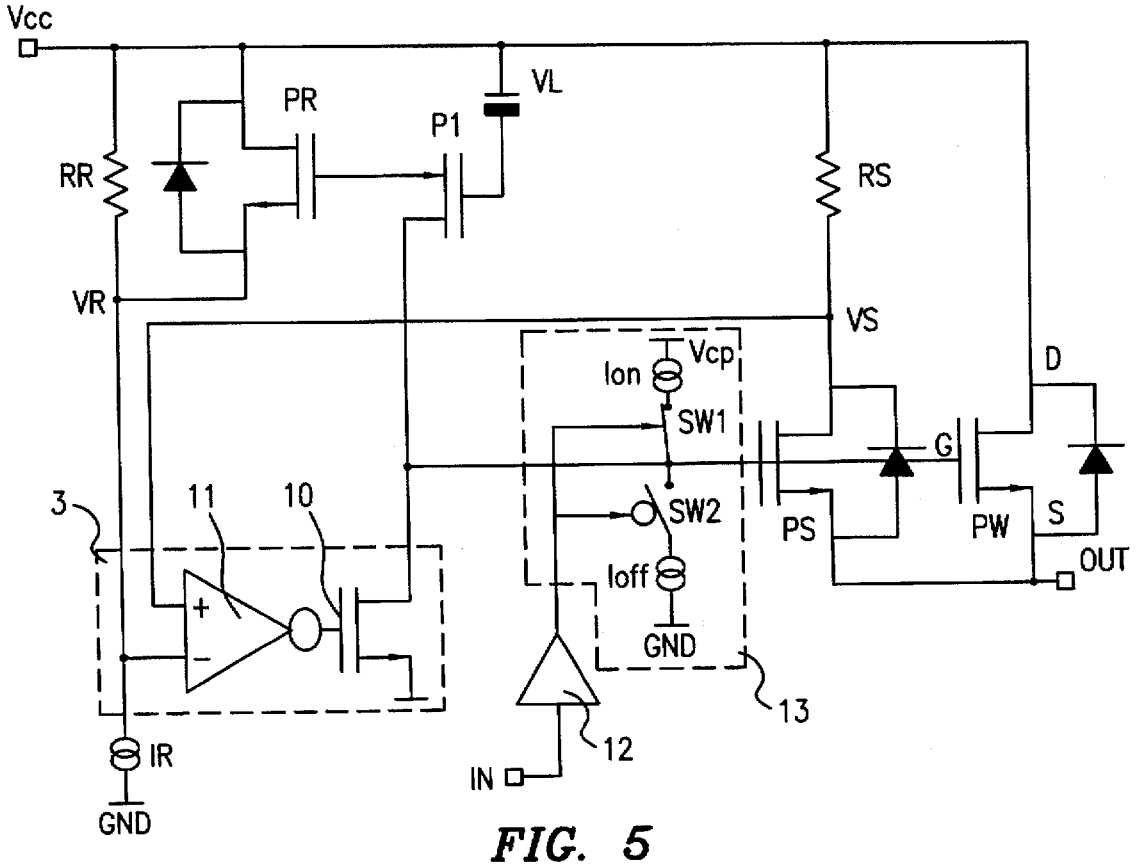
FIG. 5 shows a circuit diagram of a final stage of a power actuator incorporating a current limitation circuit provided in accordance with the present invention.

The solution proposed in the circuit of FIG. 4 was implemented in an intelligent power actuator—or Intelligent High Side Switch—provided in accordance with the circuit diagram of FIG. 5.

In the applicative circuit of FIG. 5 the following circuit parts can be distinguished:

- a power transistor PW having a control terminal G, a first principal conduction terminal D and a second principal conduction terminal S;
- an input stage 12,
- a driver stage 13 of a power transistor PW,
- a limitation circuit for the maximum current delivered by the power transistor PW provided in accordance with the principle of the circuit described in FIG. 4.

The input stage 12 receives an input signal IN and controls the driver stage 13.

The control terminal G of the transistor PW is connected through a first switch SW1 to a first current generator Ion and, through a second switch SW2, to a second current generator Ioff. The switches SW1 and SW2 are electronic switches controlled by two mutually complementary ignition signals coming from the input stage 12.

The first principal conduction terminal D and the second principal conduction terminal S of the power transistor PW identify a principal conduction path D-S which is connected between a positive pole Vcc of a power supply generator and the output node OUT of the actuator itself.

A sense transistor PS has a principal conduction path connected in series with a resistor RS in parallel with the principal conduction path (D-S) of the power transistor PW between the positive pole Vcc and the output node OUT of the actuator.

The gate terminals of the transistors PW and PS are both connected to the output of the pilot stage 13 and to the output of an operational amplifier 3 used as a voltage comparator. The operational amplifier 3 comprises a differential input section 11 and a MOS-type output transistor 10.

A non-inverting input of the amplifier 3 is connected to the common node between the sense transistor PS and the sense resistor RS, while an inverting input is connected to the common node between a reference current generator IR and a resistor RR. The resistor RR and the generator IR are connected in series between the positive pole Vcc of the power supply generator and a ground reference GND of the circuit so as to generate a reference voltage VR.

In parallel with the resistor RR is placed the conduction path of a transistor PR having a control terminal—or gate—connected through the conduction path of another transistor P1 to the output terminal of the operational amplifier 3 and then to the control terminals of the transistors PW and PS.

The function of the transistor P1 is that of protecting from overvoltages the control terminal of the transistor PR. It limits the voltage present on this terminal to prevent it from falling below a certain voltage set by the reference voltage VL applied to the control terminal.

The operation of the current limitation circuit used in the intelligent power actuator of FIG. 5 is similar to that described above for the circuit of FIG. 4.

The behavior of the short circuit current Icc as a function of the output voltage Vout for the circuit of FIG. 5 is shown in the chart of FIG. 6. FIG. 6 shows clearly the difference between an actuator of known type, curve 20, and an actuator provided in accordance with the present invention, curve 21. Indeed, in curve 21 the current peak opposite the output voltages near the positive pole Vcc is eliminated.

In the practical embodiment of the actuator of FIG. 5 the following values for the transistors PW, PS and PR, the resistors RS and RR and the current generator IR were used:

| | |
|---|---|
| Power transistor PW | W = 190 mm |
| Sense transistor PS | W = 10 mm |
| Reference transistor PR | W = 0.1 mm |
| Sense resistor RS | 4 Ω |
| Reference resistor RR | 400 Ω |
| Reference current IR | 1 mA |

where W is the width of the MOS transistor channels. The channel width of the transistor PW must not suggest a single MOS transistor 190 mm wide but a transistor designed with several MOS transistors in parallel and mutually interdigited (for example 190 MOS with W=1 mm). This can be achieved thanks to a well known layout technique by alternately superimposing the source and drain diffusions.

With these data, and with n=20 and m=100, there was obtained a short circuit current Icc of 2A and a peak current Ip of 7A was eliminated as may be seen in the chart of FIG. 6.

What is claimed is:

1. A circuit for limitation of a maximum current delivered by a power transistor having at least one control terminal and two principal conduction terminals which identify a principal conduction path, the circuit comprising:

a network for detection of the current delivered by the power transistor, coupled to the principal conduction path of the power transistor to generate a first electrical signal proportional to said current;

a reference network inserted between a first and a second power supply pole, to generate a second reference electrical signal;

an operational amplifier having a first (+) and a second (−) input terminal and an output terminal with the first input terminal (+) connected to the detection network, the second input terminal (−) connected to the reference network and the output terminal being coupled to the control terminal of the power transistor;

wherein the output terminal of the amplifier is coupled also to the reference network to regulate the value of the second reference electrical signal.

2. A circuit in accordance with claim 1, wherein the reference network comprises:

a first resistor; and a first transistor having a conduction path placed, in series with the first resistor, between the two principal conduction terminals of the power transistor and having a control terminal connected to the control terminal of the power transistor.

3. A circuit in accordance with claim 2, wherein the reference network comprises a second resistor and a reference current generator connected in series between a first and a second power supply pole with a common node between the second resistor and the current generator being connected to the second input terminal of the amplifier and wherein the second electrical signal is a reference voltage signal.

4. A circuit in accordance with claim 3, wherein the output terminal of the amplifier is coupled to the reference network through a second transistor with the second transistor having its conduction path connected in parallel with the second resistor and a control terminal connected to the output terminal of the amplifier.

5. A power actuator of an intelligent type comprising:

at least one power transistor having at least one control terminal and two principal conduction terminals which identify a principal conduction path, an input stage, a driver stage of the power transistor, a circuit for limitation of a maximum current delivered by the power transistor which comprises:

a network for detection of the current delivered by the power transistor coupled to the principal conduction path of the power transistor to generate a first electrical signal proportional to said current; and a reference network inserted between a first and a second power supply pole to generate a second reference electrical signal, and an operational amplifier having a first (+) and a second (−) input terminal and an output terminal, with the first input terminal (+) connected to the detection network, the second input terminal (−) connected to the reference network and the output terminal being coupled to the control terminal of the power transistor;

wherein the output terminal of the amplifier is coupled also to the reference network to regulate the value of the second reference electrical signal.

6. A power actuator in accordance with claim 5, wherein the detection network comprises:

a first resistor; and a first transistor having a conduction path placed, in series with the first resistor, between the two principal conduction terminals of the power transistor and having a control terminal connected to the control terminal of the power transistor.

7. A power actuator in accordance with claim 6, wherein the reference network comprises a second resistor and a reference current generator connected in series between a first and a second power supply pole with the common node between the second resistor and the current generator being connected to the second input terminal of the amplifier and wherein the second electrical signal is a reference voltage signal.

8. A power actuator in accordance with claim 7, wherein the output terminal of the amplifier is coupled to the reference network through a second transistor, with the second transistor having a conduction path connected in parallel with the second resistor and a control terminal connected to the output terminal of the amplifier.

9. A power actuator in accordance with claim 8 wherein the output terminal of the amplifier is coupled to the control terminal of the second transistor through a third transistor having a control terminal connected to a reference voltage and a conduction path connected between the control terminal of the second transistor and the output terminal of the amplifier.

* * * * *